United States Patent [19]

Bonnett

[11] 3,940,013

[45] Feb. 24, 1976

[54] PLASTIC DRUM

[75] Inventor: Richard L. Bonnett, Eldora, Iowa

[73] Assignee: Quality Products, Inc., Eldora, Iowa

[22] Filed: Apr. 8, 1974

[21] Appl. No.: 459,064

[52] U.S. Cl. ..... 220/94 R; 206/510; 215/1 C

[51] Int. Cl.[2] ..... B65D 25/28

[58] Field of Search. 294/67 R, 67 A, 67 D, 67 DA, 294/67 DB, 68, 71, 86 R; 108/51, 52, 55, 57, 58; 206/506, 509, 510; 214/300, 307, 620, 621; 215/1 C; 220/1 B, 1 BC, 1 M, 1 T, 1.5, 5 R, 69, 70, 94 R, 94 A, DIG. 1

[56] References Cited

UNITED STATES PATENTS

| | | | |
|---|---|---|---|
| 2,387,270 | 10/1945 | Johnson | 206/510 |
| 3,162,330 | 12/1964 | Dickson et al. | 214/621 X |
| 3,207,359 | 9/1965 | Heisler et al. | 220/94 A X |
| 3,250,434 | 5/1966 | Howlett | 220/94 A UX |
| 3,667,403 | 6/1972 | Angelbeck | 108/58 |
| 3,812,995 | 5/1974 | Lewis | 220/1.5 |

FOREIGN PATENTS OR APPLICATIONS

| | | | |
|---|---|---|---|
| 521,057 | 5/1940 | United Kingdom | 206/510 |

*Primary Examiner*—James B. Marbert
*Assistant Examiner*—Johnny D. Cherry
*Attorney, Agent, or Firm*—Zarley, McKee, Thomte & Voorhees

[57] ABSTRACT

A plastic drum comprising a bottom portion, a generally cylindrical side wall extending upwardly from the bottom portion, and a top portion closing the upper end of the side wall. The top portion has an elongated channel formed therein which extends completely thereacross. A support means is secured to the top portion and extends over the channel. The channel is uninterrupted with protuberances to permit a tine means of a lifting apparatus to be inserted therein below the support means so that the lifting apparatus may transport the drum. A pair of pouring spouts are provided on opposite sides of the channel outwardly of the support means.

7 Claims, 5 Drawing Figures

PLASTIC DRUM

BACKGROUND OF THE INVENTION

This invention relates to a drum and more particularly to a plastic drum having means on the upper end thereof which enables the drum to be transported by a lifting apparatus.

Large drums such as those having fifty-five (55) gallon capacities are difficult to transport from one location to another. Slings, clamps, etc. have been provided in an effort to provide a means for some sort of transport mechanism to be attached thereto. To the best of applicant's knowledge, a drum has not been provided having means on the upper end thereof to permit the tine of a fork truck or the like to be inserted completely therethrough for purposes of transporting the drum.

Therefore, it is a principal object of the invention to provide a drum.

A further object of the invention is to provide a plastic drum.

A further object of the invention is to provide a plastic drum having a support means secured to the top portion thereof which extends over a channel formed in the top of the drum.

A further object of the invention is to provide a drum having a channel formed in the upper end thereof which extends completely thereacross without any protuberances.

A further object of the invention is to provide a plastic drum having a pair of pouring spouts adapted to receive conventional caps.

A further object of the invention is to provide a plastic drum which may be easily stacked.

A still further object of the invention is to provide a plastic drum which is easily transported.

A still further object of the invention is to provide a plastic drum which is economical of manufacture, durable in use and refined in appearance.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
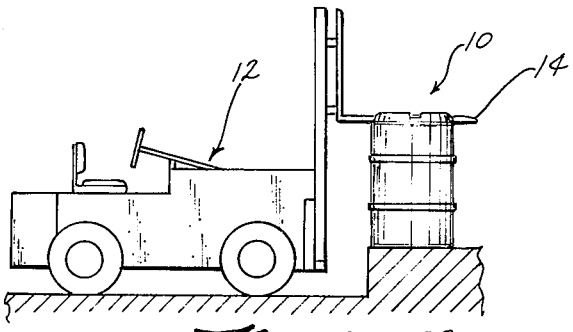
FIG. 1 is a side view illustrating a lifting apparatus positioned relative to the drum of this invention.

The numeral 10 refers generally to the drum of this invention while the numeral 12 refers to a conventional lifting apparatus such as a fork truck or the like having a tine means or member 14 extending from the forward end thereof. The tine means 14 is vertically movable in conventional fashion. Drum 10 is preferably constructed of a molded plastic material and comprises bottom portion 16, a generally cylindrical side wall 18 and top portion 20.

Figure 2:
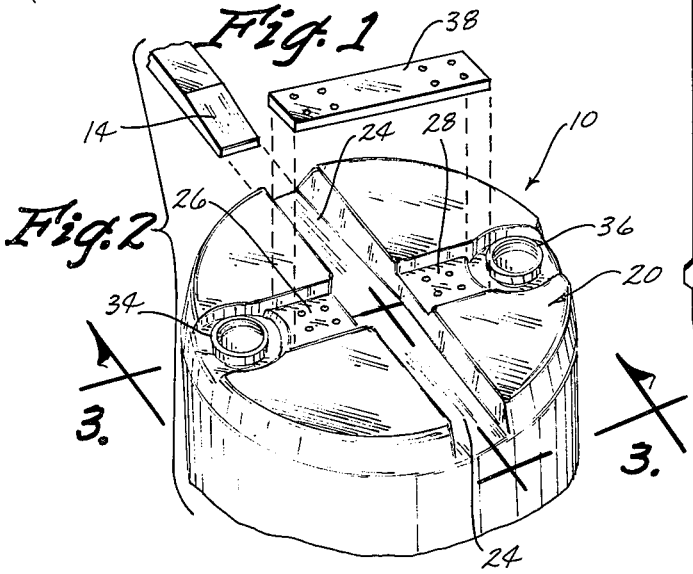
FIG. 2 is a partial exploded perspective view of the drum of this invention.
Figure 3:
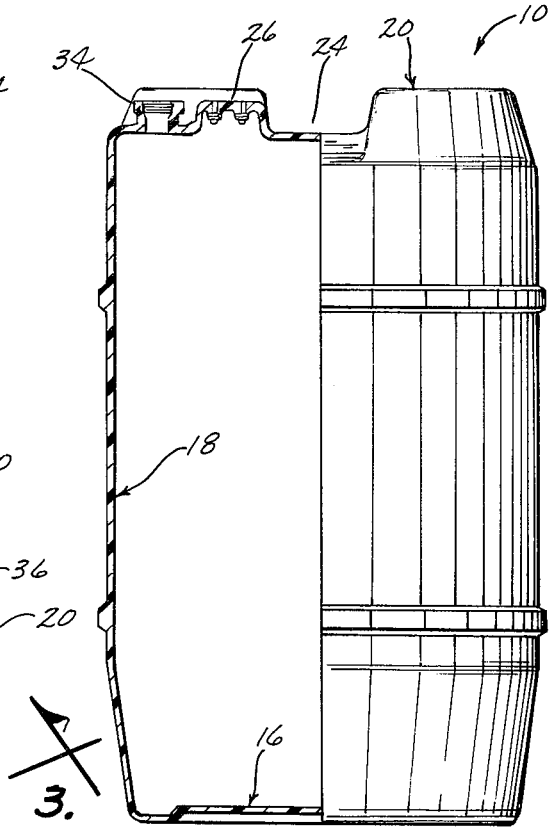
FIG. 3 is a sectional view seen on lines 3 — 3 of FIG. 2.

A channel or tunnel means 24 is formed in top portion 20 and extends completely thereacross. As seen in FIG. 2, channel means 24 is uninterrupted by protuberances such as pouring spouts or the like. Top portion 20 is also provided with channel members or recessed portions 26 and 28 positioned on opposite sides of the channel means 24 and extending transversely outwardly therefrom. As seen in the drawings, the outer portions of the recessed portions 26 and 28 dwell in a plane below the inner portions thereof. As also seen in the drawings, the upper surfaces of channel members 26 and 28 dwell in a plane below the upper surface of top portion 20.

Figure 4:
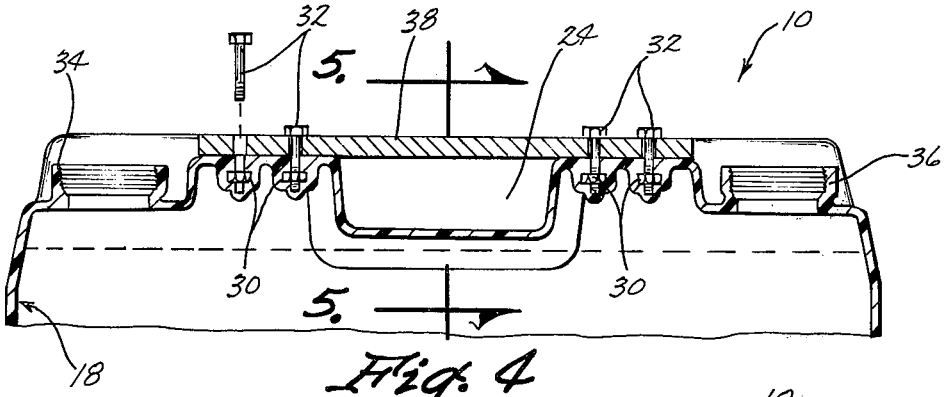
FIG. 4 is a sectional view taken through the upper portion of the drum.

A plurality of fastening members 30 are molded in top portion 20 adjacent the inner ends of channel members 26 and 28 for receiving bolt members 32. Pouring spouts 34 and 36 are provided in the outer ends of channel members 26 and 28 respectively and are adapted to threadably receive conventional closure caps. As seen in FIG. 4, the upper ends of pouring spouts 34 and 36 dwell in a plane below the upper surface of top portion 20.

Figure 5:
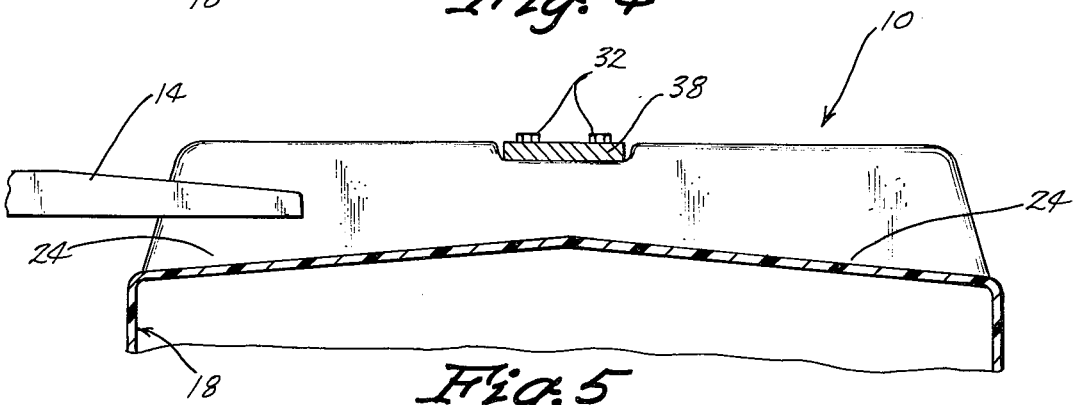
FIG. 5 is a sectional view seen on lines 5 — 5 of FIG. 4.

The support means in the form of a flat bar 38 is positioned in channel members 26 and 28 and extends across channel means 24. Bolts 32 extend downwardly through suitable openings formed in the opposite ends of the bar means and through suitable openings formed in channel members 26 and 28 to permit the bolts 32 to be threadably secured to the fastening members 30. Bar 38 may be comprised of metal or plastic material. The upper surface of bar 38 dwells in approximately the same plane as the upper surface of top portion 20 as best illustrated in FIGS. 4 and 5 to facilitate stacking of the drums if desired.

When it is desired to transport the drum, it is simply necessary to maneuver the lifting apparatus 12 so that the tine means 14 extends through the channel means 24 beneath the bar 38. The fact that channel means 24 is free of any protuberances such as pouring spouts or the like permits the tine means to be extended completely through the channel means so that the drum will be properly supported thereon. Once the tine means 14 has been extended through the channel means 24, the lifting apparatus 12 is operated so that the drum 10 is conveyed to the desired location. The tine means 14 is easily removed from the channel means 24 at the desired location.

Thus it can be seen that a unique plastic drum has been provided which has means on the upper end thereof to facilitate its handling by a lifting apparatus such as a fork truck or the like. It can also be seen that the invention accomplishes at least all of its stated objectives.

I claim:

1. A drum, comprising, a bottom portion, a side wall means extending upwardly from said bottom, a top portion closing the upper ends of said side wall means and dwelling in a substantially horizontal plane, first and second channel means formed in said top portion and intersecting each other at substantially right angles, said first channel means being deeper than said second channel means and extending completely across said top portion, a support bar means secured to said top portion and positioned in said second channel means and extending over and through said first channel means, said first channel means being uninterrupted with protuberances to permit a tine means of a lifting apparatus to be inserted therein below said support bar means.

2. The drum of claim 1 wherein the drum is constructed of a plastic material.

3. The drum of claim 1 wherein a pair of pouring spout means are provided on said top portion on opposite ends of said second channel means.

4. The drum of claim 3 wherein said support bar means comprises a bar means secured to said top portion and having its opposite ends positioned inwardly of said pair of pouring spout means.

5. The drum of claim 3 wherein said pouring spout means are threaded for receiving conventional closure caps.

6. The drum of claim 1 wherein said top portion is comprised of a molded plastic material and wherein fastening means are provided in said top portion beneath said second channel for receiving bolt members extending through said bar means.

7. The drum of claim 1 wherein said support bar means dwells in approximately the same plane as said top portion.

* * * * *